United States Patent [19]

Hoshino

[11] Patent Number: 5,048,414

[45] Date of Patent: Sep. 17, 1991

[54] AUTOMATIC STAMPER

[75] Inventor: Hiroyasu Hoshino, Tokyo, Japan

[73] Assignee: Elm Industry Co., Ltd., Tokyo, Japan

[21] Appl. No.: 515,702

[22] Filed: Apr. 27, 1990

[30] Foreign Application Priority Data

Aug. 1, 1989 [JP] Japan ..... 1-200081
Oct. 4, 1989 [JP] Japan ..... 1-116694

[51] Int. Cl.[5] ..... B41J 1/22

[52] U.S. Cl. ..... 101/93.18; 101/93.37; 101/78; 101/103; 101/109

[58] Field of Search ..... 101/93.19, 103, 109, 101/368, 381, 78–82, 93.38, 93.39, 93.37, 316–321, 93.18, 108

[56] References Cited

U.S. PATENT DOCUMENTS

| | | | |
|---|---|---|---|
| 791,608 | 6/1905 | Butterworth et al. | 101/109 |
| 1,095,033 | 4/1914 | Sale | 101/109 |
| 2,176,160 | 5/1938 | Uhl, Jr. | 101/381 |
| 2,491,267 | 6/1946 | Jorgensen | 101/382.1 |
| 3,227,082 | 1/1966 | Lynch | 101/381 |
| 3,855,925 | 12/1974 | Funahashi | 101/333 |
| 3,898,930 | 8/1975 | Ikegami et al. | 101/316 |
| 4,187,772 | 2/1980 | Hollenbeck | 101/379 |
| 4,246,643 | 1/1981 | Hubbard | 101/91 X |
| 4,432,281 | 2/1984 | Wall et al. | 101/334 |
| 4,939,990 | 7/1990 | Inaguma et al. | 101/109 |

*Primary Examiner*—Edgar S. Burr
*Assistant Examiner*—Chris A. Bennett
*Attorney, Agent, or Firm*—Oblon, Spivak, McClelland, Maier & Neustadt

[57] ABSTRACT

Described herein is an automatic stamper for imprinting desired letters or characters on documents, which is of the type including a printing block having a plural number of stamp units mounted around the circumference of a drum, a support frame rotatably and detachably supporting the printing block, and a base structure having a document support surface and supporting thereon the support frame movably for a reciprocal movement toward and away from the document support surface. The stamp units are detachably mounted on stamp support surfaces on and around the circumferences of the drum such that the longitudinal axes of the respective stamp units are disposed parallel with the axis of the drum for the sake of compact construction, while the support frame is automatically driven from an electric motor which is adapted to be closed upon setting a document on the document support surface.

14 Claims, 4 Drawing Sheets

AUTOMATIC STAMPER

BACKGROUND OF THE INVENTION

1. Field of the Invention

This invention relates to an automatic stamping device which is capable of automatically imprinting desired letters or characters on documents.

2. Description of the Prior Art

Illustrated schematically in FIG. 7 is a conventional stamping device which is provided with a printing block 70 carrying a stamp unit 72 on each of stamp support surfaces 72 formed on the respective peripheral side surfaces of a triangular stamp holder 71. Each stamp unit 73 with a rectangular printing face is mounted on the stamp support surface 72 such that its longitudinal axis lies in a direction perpendicular to the axis of the stamp holder 71. In order to imprint a letter or letters on a document 74, the printing block 70 is turned about its axis until a desired stamp unit comes to a printing position on the lower side and then the printing block 70 is pressed downward with hand.

The conventional stamping device which has the rectangular stamp units 73 mounted on the holder 71 with the longitudinal axes of the respective stamp units 73 disposed in the circumferential direction of the holder, however, involves a problem that each one of the stamp support surfaces 72 of the holder is required to have, in the circumferential direction thereof, at least a length equivalent to the length of the stamp unit 73 to be mounted thereon, often resulting in a printing block 70 of an extremely large outside diameter barring provision of a compact device. For example, in case of a printing block 80 which has six stamp units 83 mounted on six stamp support surfaces 82 of a hexagonal holder 81 as shown in FIG. 8 to permit a greater variety of printing, the distance d from the center of the holder 81 to each apex needs to be at least equivalent to the length l of the stamp unit 83, and consequently the rotational diameter of the printing block as a whole including the stamp units 83 becomes more than two times as large as the length of the stamp unit 83.

Besides, the conventional stamping device requires to press down the printing block with hand when imprinting a stamp on document. Such a printing operation is troublesome, in addition to the difficulty of applying constant printing pressures on the printing block for the purpose of obtaining clean and clear impressions.

SUMMARY OF THE INVENTION

It is an object of the present invention to provide an automatic stamper which is adapted to imprint stamps on documents by means of a printing block having a plural number of stamp units mounted around the circumference of a drum, the stamper employing a printing block which is compact in size and capable of automatically imprinting a selected stamp upon setting a document in a predetermined position.

In accordance with the present invention, for achieving the above-mentioned object, there is provided an automatic stamper including a printing block having a plural number of stamp units mounted around the circumference of a drum, a support frame detachably and rotatably receiving support shafts at the opposite ends of the drum of the printing block in bearing holes, and a base member having a document support surface for setting thereon a document to be imprinted with a stamp and supporting the support frame movably for vertical movements toward and away from the document support surface, characterized in that the automatic stamper comprises: a plural number of stamp units detachably mounted on a corresponding number of stamp support surfaces formed on the circumference of the drum with the longitudinal axes of the respective stamp units disposed parallel with the axis of the drum; an electric motor for driving the support frame; and a switch adapted to be closed upon setting a document on the document support surface to actuate the motor for one reciprocal movement of the support frame toward and away from the document.

Accordingly, in the present invention, each one of the stamp support surfaces on the circumference of the drum has a reduced length corresponding to the width of the stamp unit, so that the outside diameter of the printing block can be minimized to a considerable degree compared with a printing block which has the longitudinal axes of the stamp units disposed in a direction perpendicular to the axis of the holder as mentioned hereinbefore. In addition, a stamp is imprinted automatically upon setting a document on the document mount surface.

For mounting the stamp units on the stamp support surfaces of the drum, a hook with a short length of engagement and a coupling hole are formed on the stamp unit and each stamp support surface to facilitate attachment and detachment of the stamp units, permitting to engage or disengage the hook and coupling hole by shifting the stamp unit in the axial direction of the drum in a slight degree corresponding to the length of engagement of the hook. In this instance, a set of a hook and a coupling hole may be provided on both of the stamp unit and stamp support surface.

The printing block is provided with disk-like handles at the outer ends of the support shafts at the opposite end of the printing block drum. Conveniently, each handle preferably bears on its surface index numbers or index marks corresponding to the respective stamp units on the printing block, so that the user can select a desired stamp unit by way of the index number or mark.

Further, it is desirable to provide a detention mechanism between the support frame and the printing block to rotate the latter intermittently or stepwise each time through a predetermined angle. Such a detention mechanism may be constituted by a combination of a resilient stopper member protruding into the bearing hole at each side of the support frame and radial projections provided at uniform intervals around the circumference of each support shaft of the printing block in positions corresponding to the respective stamp units.

The motor and support frame are coupled through a cam mechanism which is constituted by a cam member mounted on the output shaft of the motor and a cam receiver which is mounted on the support frame to convert the rotational movement of the cam member into a linear reciprocal movement of the frame. Preferably, the cam receiver and support frame are arranged to be displaceable relative to the each other in the printing direction, with a resilient means interposed therebetween for adjustment of the printing stroke of the support frame.

The above and other objects, features and advantages of the invention will become apparent from the following description, taken in conjunction with the accompanying drawings which show by way of example a preferred embodiment of the invention.

DESCRIPTION OF PREFERRED EMBODIMENTS

Figure 1:
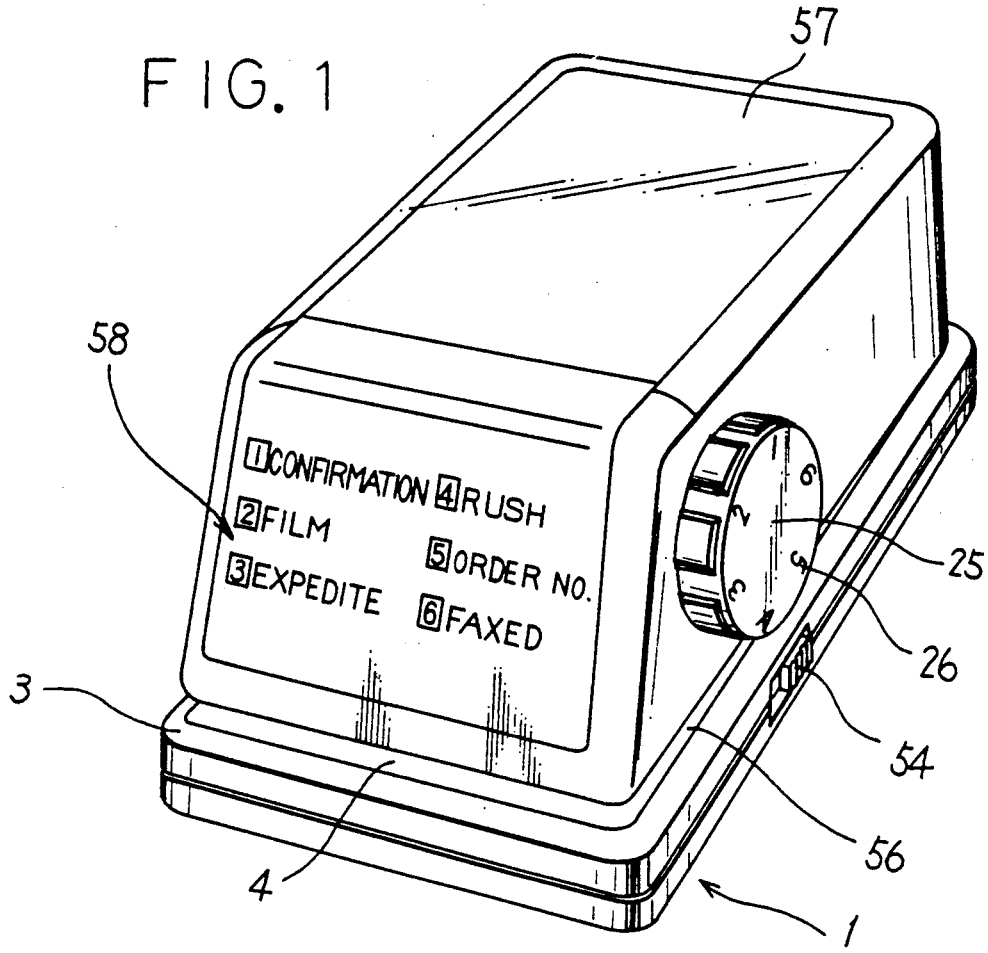
FIG. 1 is a perspective view of an automatic stamper according to the present invention.
Figure 2:
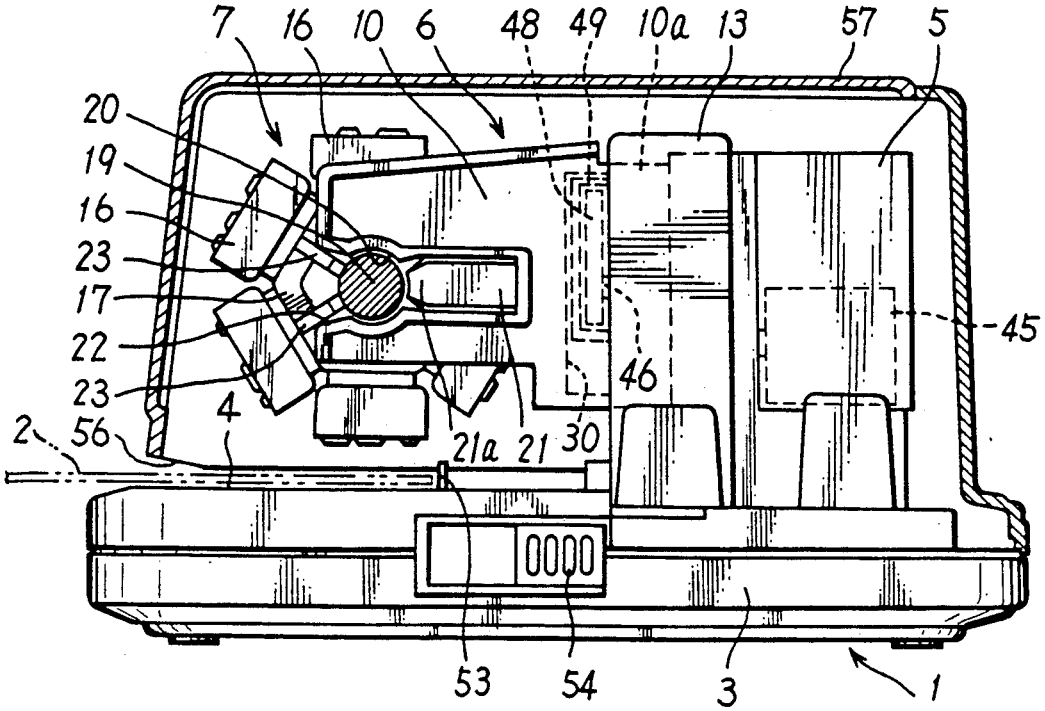
FIG. 2 is a partly vertically sectioned view of the stamper.
Figure 3:
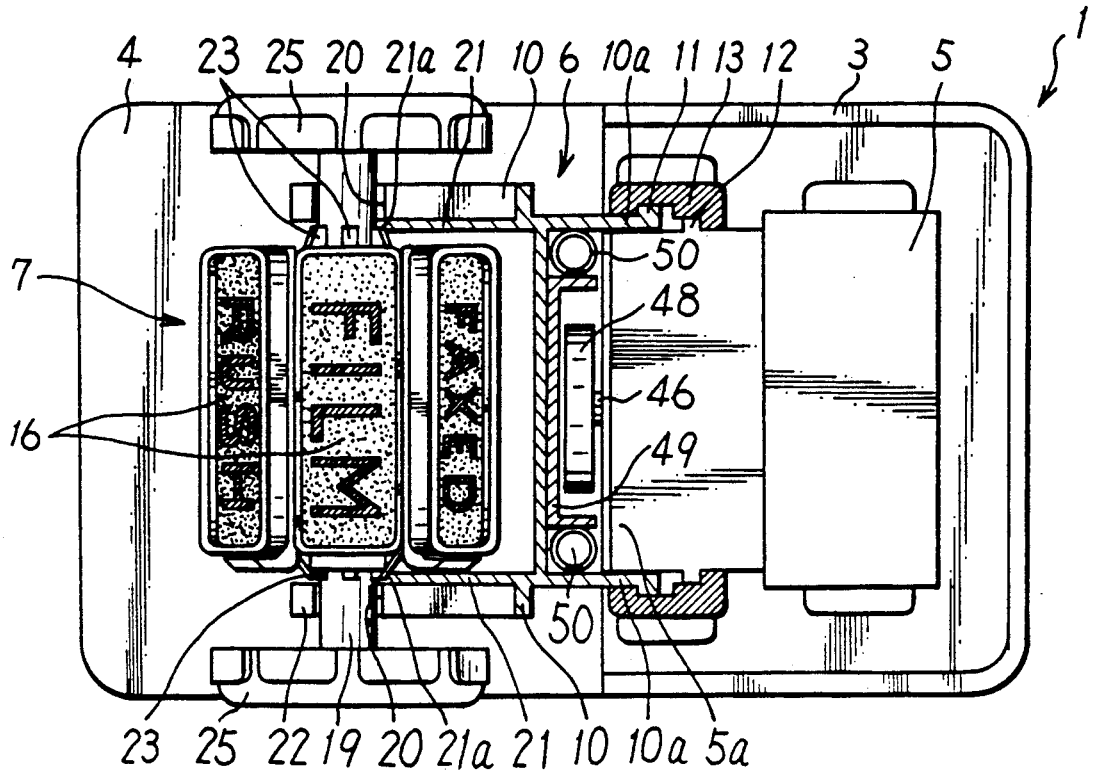
FIG. 3 is partly horizontally sectioned view of the stamper with a cover removed therefrom.

Hereafter, the invention is described more particularly by way of a preferred embodiment shown in the drawings.

Referring to FIGS. 1 through 4, the reference numeral 1 denotes a base structure of the stamper, which is provided with a rectangular base member 3 with a document mount surface 4 for supporting thereon a document to be printed with a stamp, and a fixed frame 5 located rearward of the document mount surface 4 of the base member 3. A support frame 6 which supports a printing block 7 thereon is vertically movably mounted on the front wall of the fixed frame 5.

The support frame 6 is provided with a pair of sliding walls 10*a* which are extended rearwardly from bearing arms 10 at the opposite sides of the frame 6. The sliding walls 10 are positioned to embrace a guide portion 5*a* at the front end of the fixed frame 5, and are supported slidably for upward and downward movements along the guide portion 5*a* by means of interlocking members 13 of generally arch-like shape in section which are fixed on the opposite lateral sides of the fixed frame 5 in engagement with locking flanges 11 on the outer side of the sliding walls 10*a* locking flanges 12 on the lateral sides of the fixed frame 5. Accordingly, upon extracting the interlocking members 13 upward, the support frame 6, the support frame 6 can be detached from the fixed frame 5. The base structure 1 and support frame 6 may be formed of a synthetic resin material.

Figure 5:
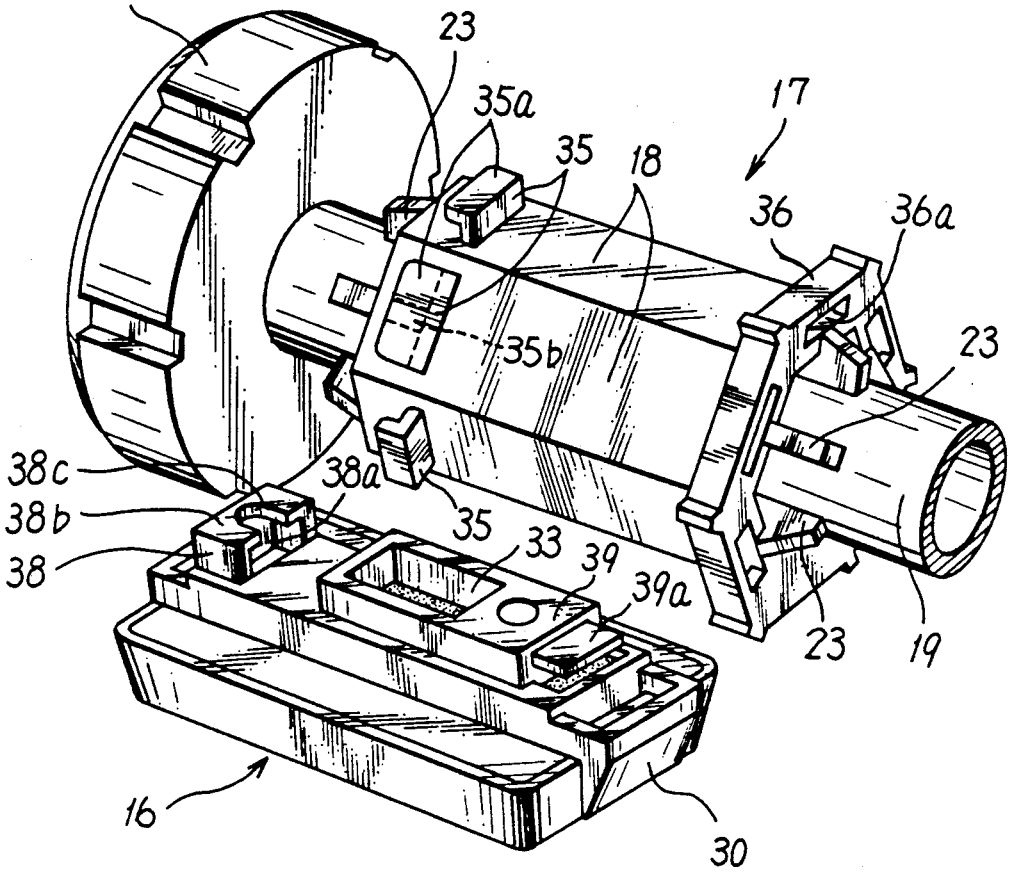
FIG. 5 is an exploded perspective view of a printing block.
Figure 6:
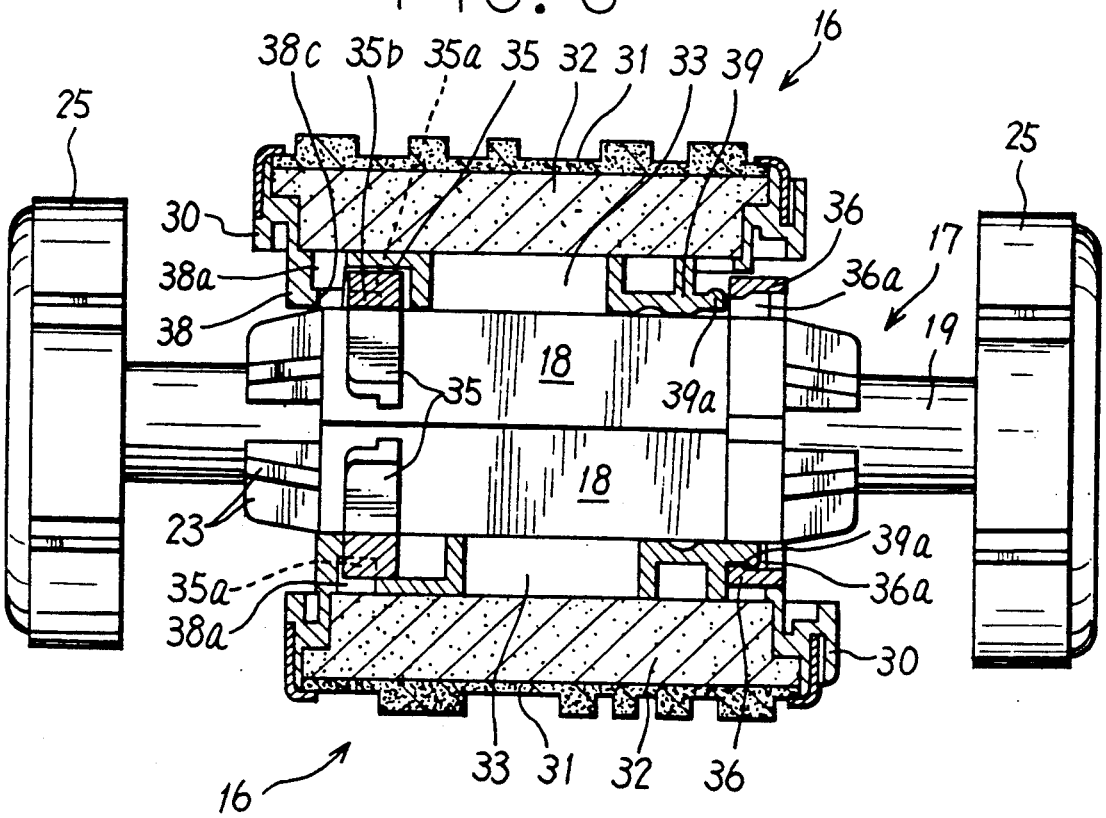
FIG. 6 is a sectional view of the printing block.
Figure 7:
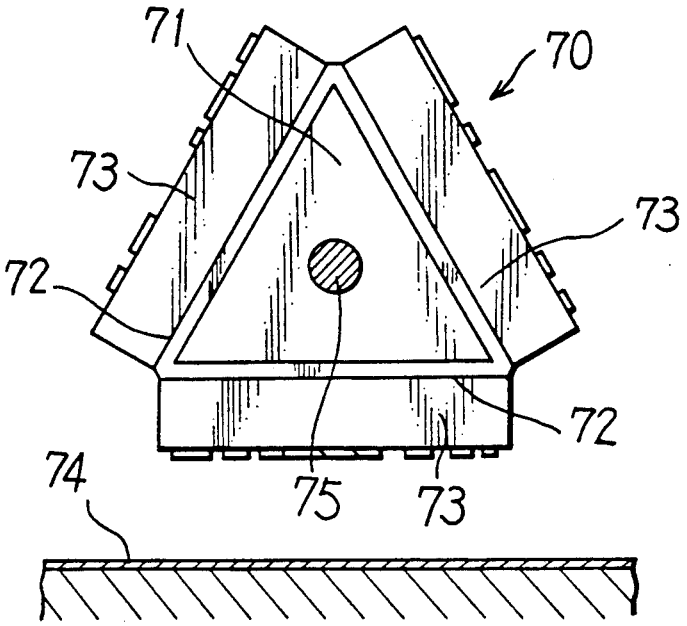
FIGS. 7 and 8 are schematic illustrations of a conventional counterpart.
Figure 8:
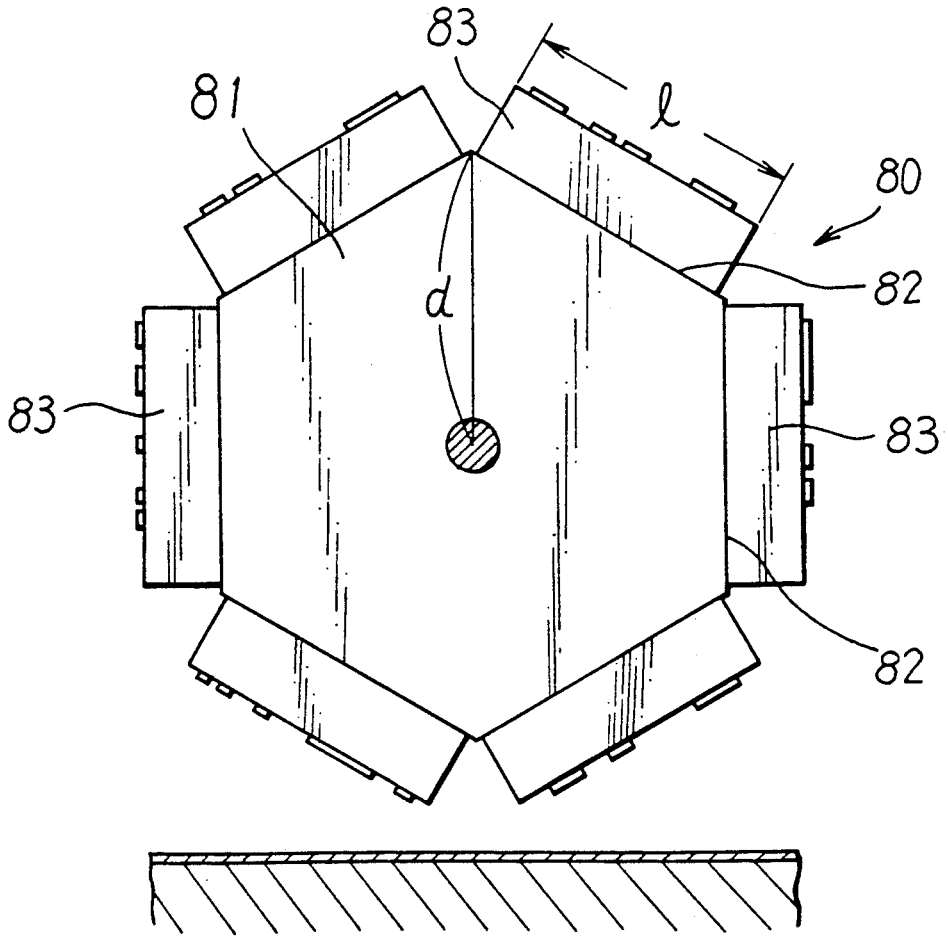

As seen in FIGS. 5 and 6, a plural number of rectangular stamp units, each having desired letters or characters engraved on the printing face, are detachably mounted on stamp support surfaces 18 formed around the outer periphery of a sectionally polygonal drum 17 of the printing block in such a manner that the longitudinal axes of the stamp units are disposed parallel with the axis of the drum 7. Consequently, the printing block can be reduced in outer diameter to a marked degree as compared with printing blocks on which the stamp units are mounted with the respective longitudinal axes disposed in a direction perpendicular to the axis of the holder.

As described hereinafter, the printing block 7 is detachably mounted on the support frame 6 and rotatable stepwise each time through a predetermined angle. Namely, as clear from FIGS. 2 and 3, the bearing arms 10 at the opposite sides of the support frame 6 are each provided with a bearing hole 20, an elastically deformable resilient stopper member 21 having its fore end portion 21*a* extended into part of the corresponding bearing hole 20, and a notch 22 for detachably mounting the support shaft 19 on the fore end portion of the bearing arm 10. On the other hand, blade-like radial projections 23 are provided at uniform intervals around the circumference of the support shaft 19 in positions corresponding to the respective stamp units 16 (FIGS. 5 and 6). Thus, a detention mechanism which restrict free rotation of the printing block 7 is constituted by these resilient stopper members 21 and blade-like radial projections 23. Accordingly, unnecessary rotation of the printing block 7 is blocked by the fore ends 21*a* of the resilient stopper members 21 which engage between the adjacent blade-like projections 23 on the support shafts. When the printing block 7 is rotated intentionally, the resilient stopper members 21 are elastically deformed to ride over the projections 23 successively one after another, permitting the printing block 7 to rotate intermittently or stepwise each time through a predetermined angle.

Index marks, for example, index numbers 26 corresponding to the respective stamp units 16 are put on the surface of at least one of the disk-like handles 25 which are attached to the outer ends of the support shafts 19, so that the user can select a desired stamp unit 16 by way of the corresponding index number 26. Namely, a desired stamp unit 16 can be selectively put in a lower printing position simply by turning a handle or handles 25 until the corresponding index number comes to a predetermined position. At the time of replacement of a stamp unit or units 16, the printing block 7 can be easily detached from the support frame 6 through the notches 22.

Desirably, the support frame 6 and printing block 7 are formed in a symmetrical shape, so that the printing block 7 can be mounted in an axially reversed position on the support frame 6. The reversal of the mounting position of the printing block 7 permits to make impressions in an appropriate direction on both upper and lower portions of documents.

The blade-like projections 23 may be provided either on the drum 17 or on the support shaft 19 whichever is desirable.

As shown particularly in FIGS. 5 and 6, the impression members 16 are each constituted by a case 30 of a metallic or synthetic resin material accommodating therein an impression member 31 of a porous material and an ink holding member 32 which is impregnated with ink to supply a necessary amount of ink automatically to the impression member 31. In case of ink exhaustion, ink is re-charged into the ink holding member 32 through an ink replenishing hole 33. Each stamp unit 16 is mounted on the stamp support surface 18 in the manner as described below.

At one longitudinal end, each stamp support surface 18 on the circumference of the drum 17 is integrally formed with a short hook member 35 having at the upper end thereof a hook portion 35*a* of short coupling length extending parallel with the stamp support surface 18. At the other end, the stamp support surface 18 is integrally formed with a socket member 36 with a coupling recess 36*a*. On the other hand, formed integrally at one axial end of the rear coupling side of the stamp unit 16 is socket member 38 with a recess 38*a* which is engageable with the hook portion 35*a* of the hook member 35. At the other end of the coupling rear side, the stamp unit 16 is integrally formed with a hook member 39 with a hook portion 39*a* of short length of engagement, which is engageable with the recess 36*a* on the stamp support surface 18. As shown in upper and lower halves of FIG. 6, each stamp unit 16 can be detachably mounted on a stamp support surface 18 upon engaging the hooks 25 and 39 with the recesses 36 and 38, respectively, by relatively displacing the stamp unit 16 in the axial direction of the drum 17 by an extremely short distance corresponding to the length of the hook portions 35*a* and 39*a*. The hook member 35 which is formed on the stamp support surface 18 is centrally provided with a coupling wall portion 35 rising perpendicularly from the stamp support surface 18 for engagement with a notched portion 38*c* which is formed centrally in an upper wall 38*b* of the socket member 38 on the stamp unit 16. By engagement of the coupling wall portion 35 with the notched portion 38*c*, the stamp unit 16 is held in position stably without staggering sideward movements.

Thus, the stamp unit 16 can be attached to or detached from the drum 17 in an extremely facilitated manner, namely, simply by sliding the stamp unit 16 along the stamp support surface 18 by a very short distance corresponding to the coupling length of the hook 35 and 39.

The support frame 6 is driven from an electric motor which is mounted within the fixed frame 5 and which is connected through a reducing mechanism, not shown, to an output shaft 46 which is extended through the front wall of the fixed frame 5 and coupled with the support frame 6 through a cam mechanism. The cam mechanism includes an eccentric cam disc 48 which is fixedly mounted on the output shaft 46, and a cam receiver 49 which is attached to the support frame 6 to convert an eccentric rotational movement of the cam disc 48 into a reciprocal vertical movement. The cam receiver 49 is in the form of a shallow cup with lower and upper peripheral wall portions 49*a* and 49*b* to be abutted against the cam 48, and located in an indented portion of the support frame 6 displaceably relative to the latter in the printing direction. A compression spring 50 is interposed between a stepped portion on each side of the cam receiver 49 and a bottom wall portion 6*a* of the support frame. As the cam 48 is driven to make one revolution within the cam receiver 49, the support frame 6 is moved vertically to make one reciprocal movement toward and away from the base thereby to imprint letters or characters with a stamp unit 16. Namely, during the first half revolution, the cam 48 is abutted against the lower peripheral wall portion 49*a* of the cam receiver 49 to push down the latter, and therefore the support frame 6 is pushed down by the spring 50 to imprint a stamp on the document 2. In the succeeding second half revolution, the cam 48 is abutted against the upper peripheral wall portion 49*b* of the cam receiver 49 to push up the latter which has already been urged into abutting engagement with the upper wall portion 6*b* of the support frame 6 by the biasing force of the spring 50, lifting up the support frame 6 with the cam receiver 6. At this time, the spring 50 which resiliently couples the cam receiver 49 with the support frame 6 has a function of adjusting the printing stroke of the support frame 6 in such a manner as to imprint a stamp securely on documents of various thicknesses.

Figure 4:
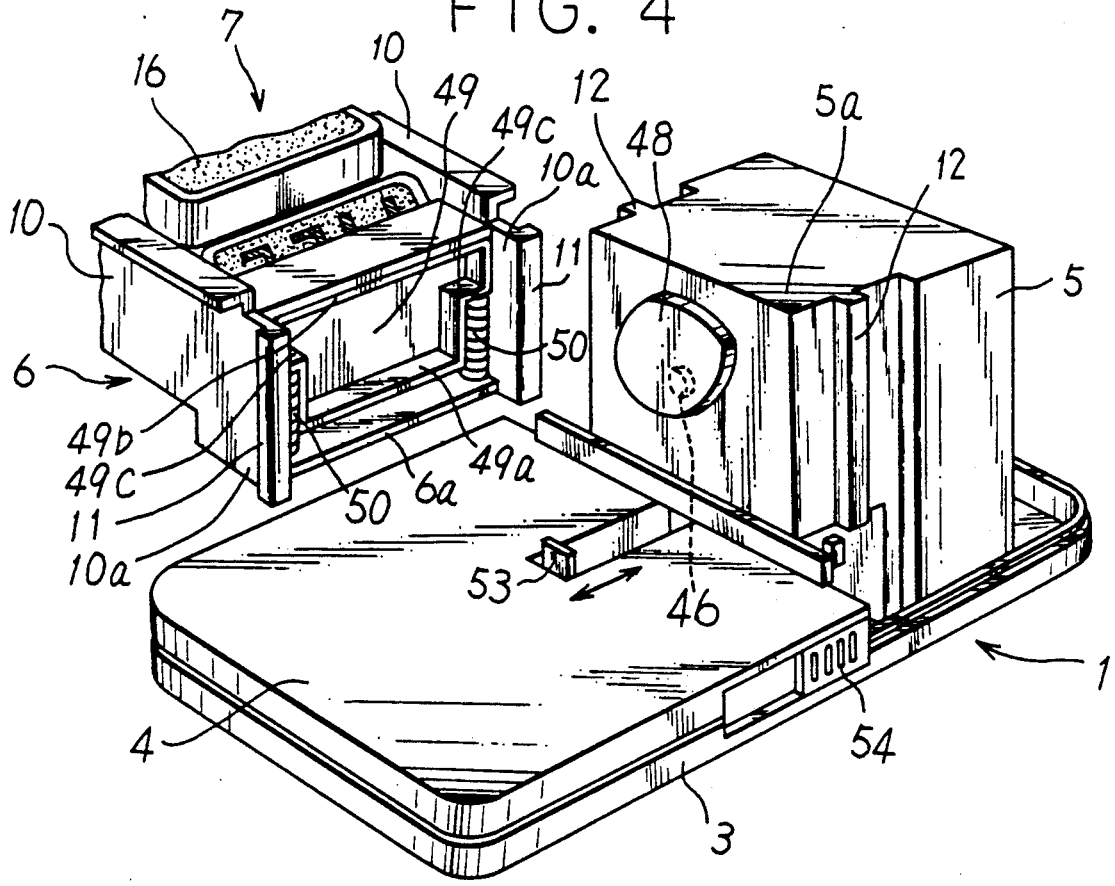
FIG. 4 is an exploded perspective view of major components of the stamper.

Upwardly projected from the document support surface 4 is a lever 53 of a switch which opens and closes the drive circuit of the motor 45, for movements in the arrowed directions in FIG. 4. Namely, as a document 2 is inserted from the front side for setting same on the document support surface 4, the lever 53 is turned down by the fore end of the document 2 to close the switch, whereupon the cam 48 is driven from the motor 45 to make one revolution during which the support frame 6 is moved to make one vertical reciprocal movement as described hereinbefore for imprinting a stamp on the document. In this instance, the cam 48 makes only one revolution even if the switch is continuedly held in the closed state since the motor 45 would not be actuated unless the switch is re-closed after withdrawal of the document 2.

The operating stroke of the switch lever 53, namely, the switch closing position of the lever 52 can be adjusted by way of an adjusting member 54 which is provided at one side of the base 3 to permit adjustment of the printing position relative to the document 2.

The fixed frame 5, support frame 6 and printing block 7 are housed in a cover 57, leaving a slit 56 over the document support surface 4 for insertion of document. The handles 25 of the printing block 7 are exposed at the opposite lateral sides of the cover 57. The front surface of the cover 57 bears a display 58 indicating the contents of the stamp units 16 on the printing block 7 in relation with the index numbers on the handle 25. Accordingly, one can make a desired imprint by selecting a corresponding index number according to the display 58.

With an automatic stamper of the above-described construction, a desired stamp unit 16 is firstly set in the printing position by turning the handle 25, and then a document 2 to be imprinted with the stamp is inserted onto the document support surface 4 through the slit 56, pushing back the switch lever 53 with the fore end of the document 2 to close the switch. Whereupon, the motor 45 is actuated for one revolution of the cam 48, pushing down the cam receiver 49, and as a result the support frame 6 is moved vertically for a reciprocal movement toward and away from the base 3, making an impression on the document 2 with a selected stamp unit 16 in the printing position.

What is claimed is:

1. An automatic stamper of the type including a printing block having a drum and a plural number of stamp units mounted around the circumference of said drum, said drum having support shafts at opposite ends thereof, a support frame having bearing holes for detachably and rotatably receiving said support shafts, and a base member having a document support surface for setting thereon a document to be imprinted with one of said stamp units and supporting said support frame for vertical movements toward and away from said document support surface, characterized in that said stamper comprises:

stamp support surfaces on the circumference of said drum;

means for detachably mounting said plural number of stamp units on said stamp support surfaces with the longitudinal axis of the respective stamp units disposed parallel with the axis of said drum;

an electric motor having an output shaft for driving said support frame; and a switch positioned to be closed upon setting a document on said document support surface of said base member, and means responsive to closing of said switch to actuate said motor for one reciprocal movement of said frame toward and away from said document.

2. An automatic stamper as defined in claim 1, wherein each one of said stamp units is mounted on one of said stamp support surfaces on said drum through a coupling mechanism constituted by a hook with a short length of engagement and a coupling hole provided on said stamp unit and said stamp support surface and disengageably coupled with each other by displacing said stamp unit in the axial direction of said drum over a slight distance corresponding to the length of engagement of said hook.

3. An automatic stamper as defined in claim 2, wherein a set of said hook and coupling hole are provided on each of said stamp unit and said stamp support surface of said drum.

4. An automatic stamper as defined in claim 1, wherein said stamp unit is constituted by a case of a metallic or synthetic resin material having an ink replenishing hole and accommodating therein an impression member of a porous material and an ink holding member impregnated with ink to supply a suitable amount of ink automatically to said impression member.

5. An automatic stamper as defined in claim 1, wherein said printing block is provided with handles at the outer ends of said support shafts, at least one of said handles bearing on the surface thereof index marks or numbers corresponding to the respective stamp units mounted on said printing block to permit selection of a desired stamp unit by way of a corresponding index mark or number.

6. An automatic stamper as defined in claim 5, further comprising a cover member fitted on said base member to encase therein said fixed frame, support frame and printing block, a slit formed on the front side of said stamper between said document support surface and said cover for insertion of document, and a display of the contents of said stamp units indicated on the surface of said cover in relation with said index mark or number on said handle.

7. An automatic stamper as defined in claim 1, wherein further comprising a detention mechanism provided between said support frame and said printing block for rotating the latter intermittently each time through a predetermined angle.

8. An automatic stamper as defined in claim 7, wherein said detention mechanism comprises a resilient stopper member having a tip end portion thereof disposed in said bearing hole on said support frame, and a number of radial projections provided at uniform intervals around the circumference of said support shaft of said printing block for resilient engagement with the tip end of said stopper member.

9. An automatic stamper as defined in claim 1, wherein said printing block is arranged to permit axially reversed mounting on said support frame.

10. An automatic stamper as defined in claim 1, wherein said motor is coupled with said support frame through a cam mechanism.

11. An automatic stamper as defined in claim 10, wherein said cam mechanism comprises a cam member fixedly mounted on the output shaft of said motor, and a cam receiver mounted on said support frame in engagement with said cam member for converting the rotational movement of said cam member into a vertical reciprocal movement of said support member toward and away from said base member.

12. An automatic stamper as defined in claim 11, wherein said cam receiver and support frame are relatively displaceable in the printing direction, and a resilient means is interposed between said cam receiver and support frame for adjusting the printing stroke of said support frame.

13. An automatic stamper as defined in claim 1, wherein said switch is provided with a switch lever protruding on and above the document support surface of said base member, and closed when said lever is pushed back by insertion of a document to be set on said document support surface.

14. An automatic stamper as defined in claim 13, wherein the operating stroke of said switch lever is adjustable.

* * * * *